US009254431B1

(12) United States Patent
Sites

(10) Patent No.: US 9,254,431 B1
(45) Date of Patent: Feb. 9, 2016

(54) GOLF MAT

(71) Applicant: Lowell Zane Sites, Apple Valley, CA (US)

(72) Inventor: Lowell Zane Sites, Apple Valley, CA (US)

( * ) Notice: Subject to any disclaimer, the term of this patent is extended or adjusted under 35 U.S.C. 154(b) by 0 days.

(21) Appl. No.: 14/885,698

(22) Filed: Oct. 16, 2015

(51) Int. Cl.
*A63B 69/36* (2006.01)

(52) U.S. Cl.
CPC ..... *A63B 69/3661* (2013.01); *A63B 69/3623* (2013.01)

(58) Field of Classification Search
USPC ..... 473/218, 257, 262, 278, 279
See application file for complete search history.

(56) References Cited

U.S. PATENT DOCUMENTS 5,593,355 A * 1/1997 Beaver ..... A63B 69/3661 473/262
6,120,383 A * 9/2000 Brown ..... A63B 57/0006 473/135
6,569,026 B1 * 5/2003 Weis ..... A63B 69/3655 473/139
6,705,953 B2 * 3/2004 Haskins ..... A63B 69/3661 473/150
7,549,932 B1 * 6/2009 Miyamoto ..... A63B 69/3661 473/278
2011/0070965 A1 * 3/2011 Tome ..... A63B 69/3623 473/278
2012/0178546 A1 * 7/2012 Park ..... A63B 69/3661 473/278

* cited by examiner

*Primary Examiner* — Nini Legesse
(74) *Attorney, Agent, or Firm* — Innovation Capital Law Group, LLP; Vic Lin

(57) ABSTRACT

A golfing platform includes a standing region, for a user to stand to make their golf swing, and a striking zone, where a golf ball may be placed for striking by a golf club. The striking zone may be configured to replicate the feel of real turf, but where the artificial turf covering is not taken up as divots during a golf club swing. The striking zone can include a striking zone insert which may be formed from a hollow region surrounded by a flexible tubular material and encased with a covering material. The striking zone insert may have a height substantially the same as the height of the standing platform. A matting insert material may surround the striking zone to make the entire golf platform (the standing platform, the matting insert material and the striking zone insert) of uniform height, thereby mimicking a typical golf swing from the ground.

21 Claims, 7 Drawing Sheets

GOLF MAT

BACKGROUND OF THE INVENTION

1. Field of the Invention

The invention relates generally to golf accessories, and more particularly to a golf mat that replicates the feel of natural turf without having to replace divots when making practice swings.

2. Description of Prior Art and Related Information

During a conventional golf swing, the golfer lines the club up with a golf ball which lies on a tee or a grass surface. During the swing motion, the golf club generally, and preferably, impacts the ball slightly below the ball's mid-height lateral surface to create the desired amount of vertical trajectory. To achieve the desired outcome when striking a golf ball on a grass surface, the golf club head must travel through the uppermost part of the grass surface during the follow through. Thus, upon impact, it is common for divots, which are small pockets of grass material, to be removed during a golf swing due to the shear forces created internally within the turf itself. Divots are also important in that they provide feedback to the golfer, allow a complete follow through, and provide a more controlled and accurate resultant golf ball velocity and trajectory.

Natural grass surfaces have the ability to absorb the impact of the golf club during the golf club swing due mostly in part to the underlying compressibility and impact absorbing properties of the soil substructure. As such, the golfer generally does not feel the golf club head hit the grass surface and an optimal amount of the golf club's kinetic energy is imparted to the golf ball.

In order to perfect a golf swing and resultant ball trajectory, a golfer must repetitively practice the golf swing motions and the stance during the swing. As such, it is desirable for the golfer to repeatedly practice this swinging motion in a designated area. However, as explained above, with the inherent divot creation during a normal golf swing, natural grass surfaces are not practical for a golf swing practice location due to the inevitable numerous divots created, which would subsequently render the golf practice area useless within a very short period of time.

Driving ranges enable golfers to practice their golf swings using their woods and their irons. A typical driving range may be 350 to 400 yards in length, or longer, space permitting, and of sufficient width to accommodate a number of golfers at the same time. Typically, each golfer is allotted a predetermined amount of practice space within which he or she can safely swing their club to hit a golf ball down the driving range. The golfer may hit their ball from a wooden or plastic tee or from the surface of the practice space. When the golfer uses a tee, the golfer's swing should be and usually is identical to that which the golfer uses during normal play. However, when the golfer has not used a tee and has hit a ball from the surface of a practice space, the golfer usually has been required to adjust his or her swing to accommodate the conditions of the surface of the practice space.

The nature of the surface of the practice space can vary widely at any given driving range and from driving range to driving range. For example, the surface may comprise grass covered turf which is substantially identical to the conditions which the golfer would normally encounter on a conventional golf course fairway. Under such conditions, the golfer can and normally would utilize his or her normal swing which, when using an iron and sometimes when using a wood, requires that the club head be driven downwardly and "through" the ball resulting in the making of a divot at the apex of the swing. Unfortunately, such ideal conditions are not found at many driving ranges.

There has thus been a long-standing need within the golfing art to replicate the feel and feedback of natural grass surfaces for golf practice locations. Currently, artificial grass surfaces are utilized mainly for driving ranges. Artificial grass surfaces are generally preferred over natural grass surfaces for golf practice swinging due to the fact that artificial grass has greater longevity, is not prone to naturally occurring divots, is generally more customizable, and is less costly to maintain.

However, a major problem with creating a consistent and practical artificial grass surface is to create a natural feel to the synthetic grass surface and underlying core substructure. For example, some conventional golf practice artificial grass surfaces consist of a polymer based artificial grass leaf material overlaid on a hardened surface, such as wood, concrete or the like. A major limitation of such an artificial golf practice swing surface is the lack of realistic replication of the underlying soil substructure or turf.

When the golf club hits the artificial grass surface during a normal golf swing, and since the underlying surface does not have adequate compressive abilities or impact absorbing properties, the swing path of the golf club is redirected to a plane parallel to the grass surface thereby not allowing a follow through consistent with that experienced on natural turf wherein a divot is taken. Furthermore, when the golf club hits the hardened underlying surface, more often than not, the impact by the golf club creates undesirable and potentially dangerous shocks and vibrations to the golfer, thus possibly physically harming the golfer as well as damaging the golf club itself.

Accordingly, a need exists to improve golf practice mats so that they replicate the feel of natural turf, without the disadvantages thereof.

SUMMARY OF THE INVENTION

In accordance with the present invention, structures and associated methods are disclosed which address these needs and overcome the deficiencies of the prior art.

In a first aspect of the present invention, a golf mat comprises a striking area; a striking area cutout formed in the striking area; a striking area insert covering the striking area cutout and extending into the striking area, the striking area insert formed from a first sheet and a second sheet disposed atop of each other; and a flexible resiliently compressible ring disposed between the first sheet and the second sheet, the ring disposed within the striking area cutout about a periphery thereof, wherein a hollow region is formed between the first sheet and the second sheet, inside the ring.

In a another aspect of the present invention, a golf mat comprises a striking area; a standing area disposed adjacent the striking area; a striking area cutout formed in the striking area; a striking area insert covering the striking area cutout and extending into the striking area, the striking area insert formed from a first sheet and a second sheet disposed atop of each other; a tubular ring disposed between the first sheet and the second sheet, the ring disposed within the striking area cutout about a periphery thereof, wherein a hollow region is formed between the first sheet and the second sheet, inside the ring; and a matting material disposed about the striking zone insert, covering the striking area.

In another aspect of the present invention, a golf mat comprises a striking area; a standing area disposed adjacent the striking area; a striking area cutout formed in the striking area; a striking area insert covering the striking area cutout and extending into the striking area, the striking area insert formed from a first sheet and a second sheet disposed atop of each other; a tubular ring disposed between the first sheet and the second sheet, the ring disposed within the striking area cutout about a periphery thereof, wherein a hollow region is formed between the first sheet and the second sheet, inside the ring; and a matting material disposed about the striking zone insert, covering the striking area, wherein a first height of the striking zone insert is substantially the same as a second height of the standing area; and a third height of the matting material is substantially the same as the second height of the striking area and the first height of the striking zone These and other features and advantages of the invention will become more apparent with a description of preferred embodiments in reference to the associated drawings.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, the present invention provides a golfing platform including a standing region, for a user to stand to make their golf swing, and a striking zone, where a golf ball may be placed for striking by a golf club. The striking zone may be configured to replicate the feel of real turf, but where the artificial turf covering is not taken up as divots during a golf club swing. The striking zone can include a striking zone insert which may be formed from a hollow region surrounded by a flexible tubular material and encased with a covering material. The striking zone insert may have a height substantially the same as the height of the standing platform. A matting insert material may surround the striking zone to make the entire golf platform (the standing platform, the matting insert material and the striking zone insert) of uniform height, thereby mimicking a typical golf swing from the ground.

Figure 1:
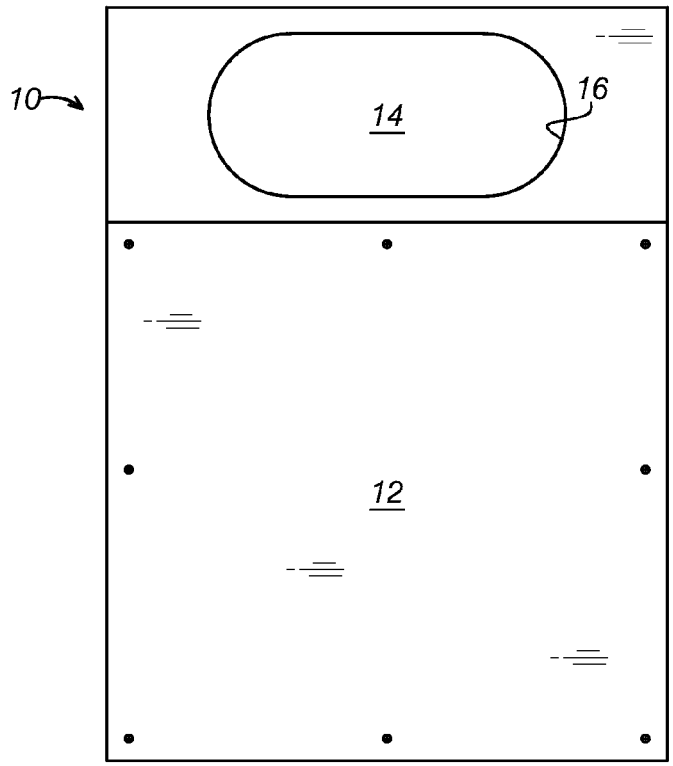
FIG. 1 illustrates a top view of a golf mat platform showing a cut-out for a striking zone insert, according to an exemplary embodiment of the present invention.

Referring now to FIG. 1, a golf mat 10 includes a standing area 12 and a striking area 16. The striking area 16 includes a striking area cutout 14. The striking area cutout 14 is typically formed as an elongated circle, oval, egg shape or the like, there the major axis of the striking area cutout 14 aligns with a direction of swing of a golf club during use of the golf mat 10, as described below.

The standing area 12 is typically formed at a height raised from the striking area 16. Typically, the standing area 12 is from about 0.5 inch to about 2 inches, usually about 0.75 to 1 inch, higher than the striking area 16. While the figure shows the areas formed as rectangular areas, various shapes and sizes are contemplated within the scope of the present invention.

Figure 2:
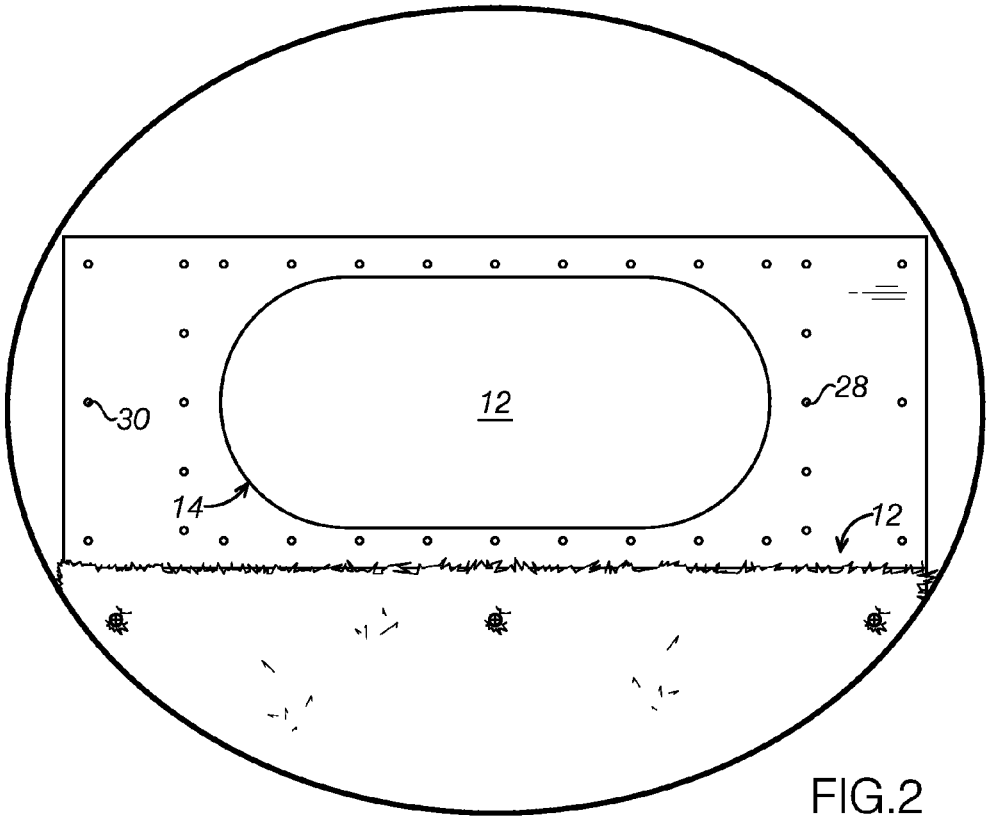
FIG. 2 illustrates a top view of the golf mat platform of FIG. 1, showing bracket holes formed about the cut-out.
Figure 3:
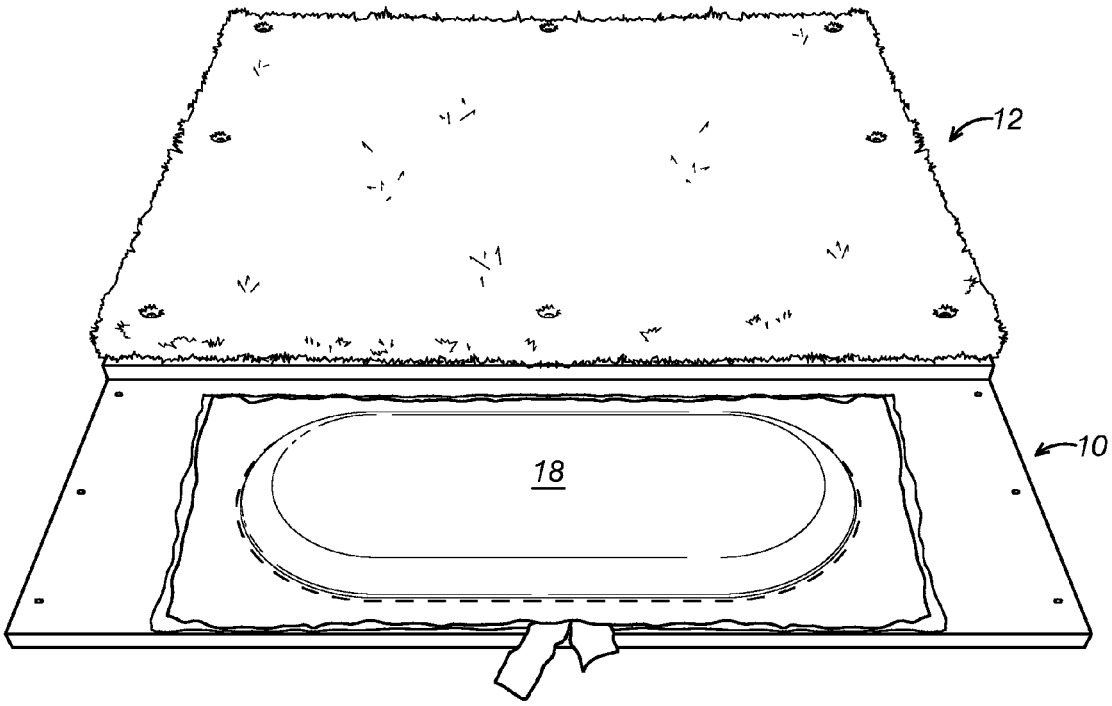
FIG. 3 illustrates a perspective view of the golf mat platform of FIG. 1 having a striking zone insert placed therein.

As shown in FIG. 2, the striking area can include a plurality of mounting holes. Striking zone insert mounting holes 28 may be disposed about the periphery of the striking area cutout 14. While the striking zone insert mounting holes 28 are shown forming a rectangular shape, they may be disposed in various configurations about the striking zone cutout 14. Matting material mounting holes 30 may be formed at front and rear ends of the striking area 16.

Figure 4:
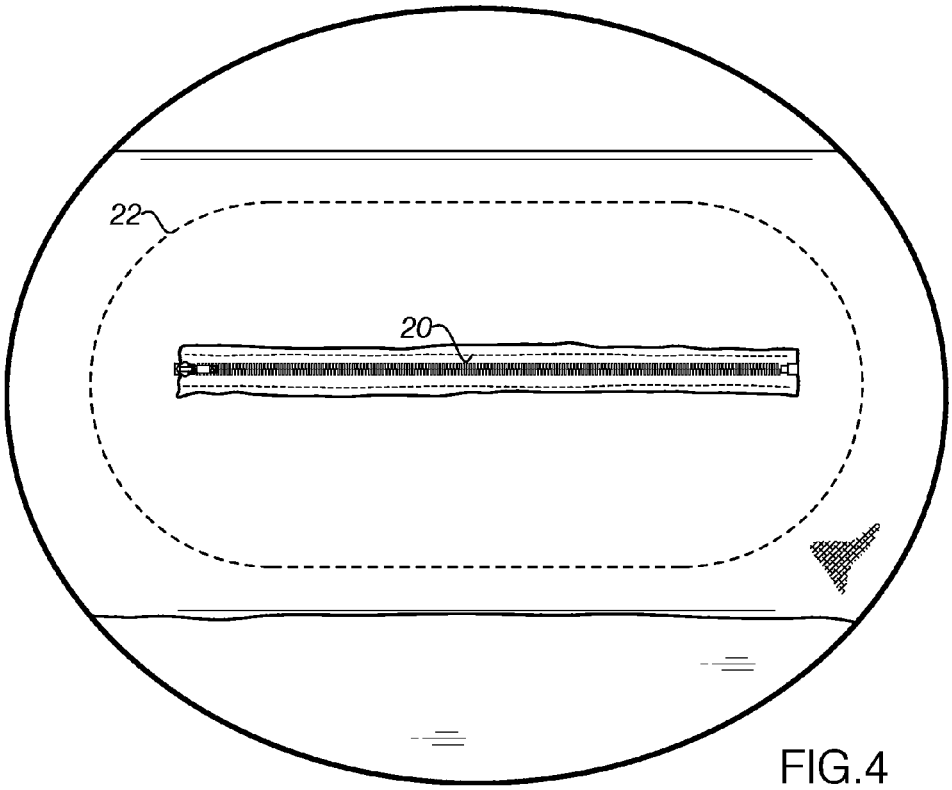
FIG. 4 illustrates a back view of the striking zone insert of FIG. 3, with a peripheral tube removed therefrom.
Figure 5:
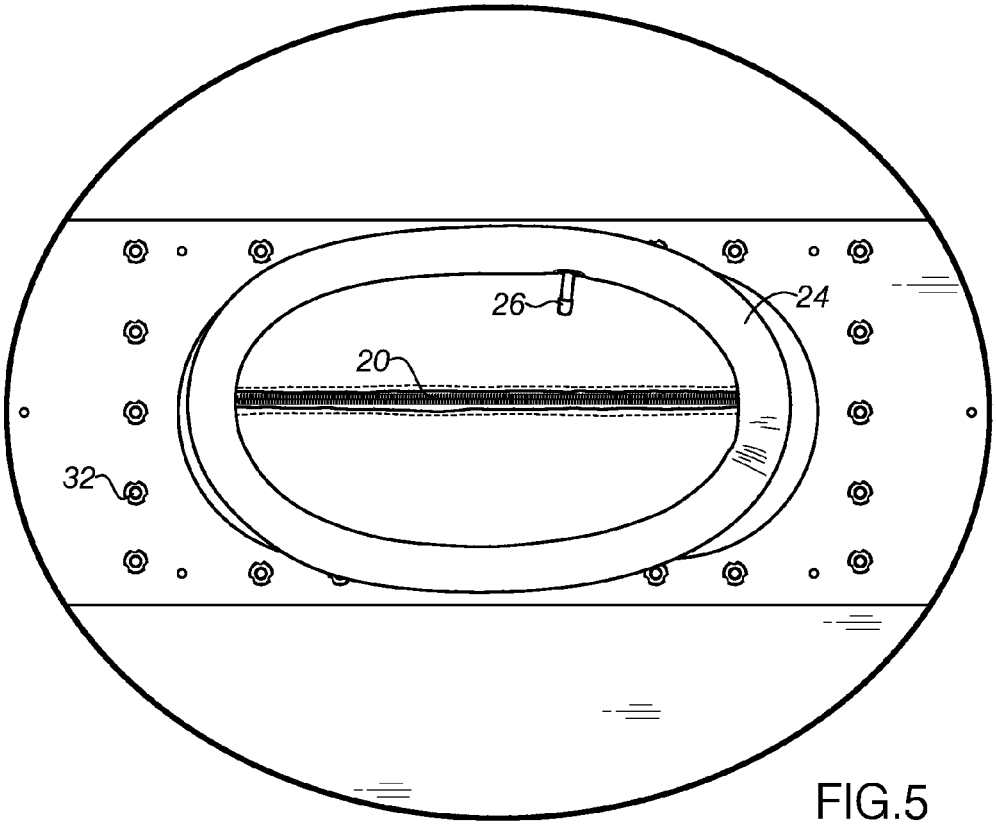
FIG. 5 illustrates a back view of the striking zone insert installed in the golf mat platform of FIG. 1.
Figure 6:
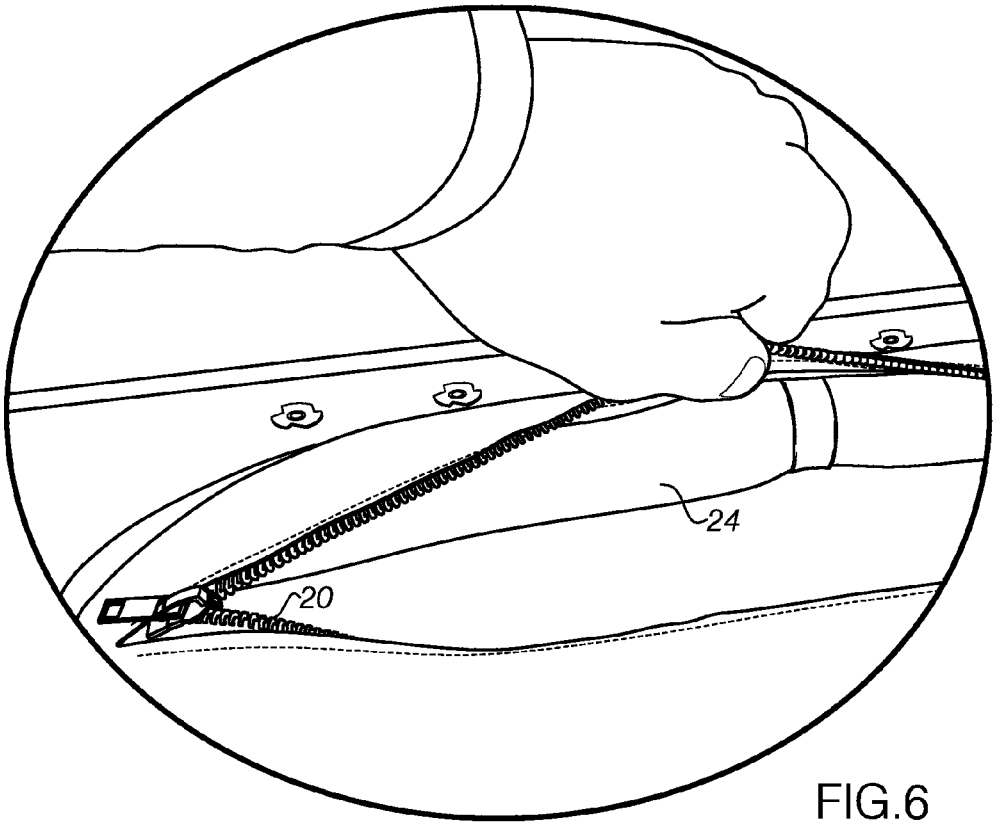
FIG. 6 illustrates a detailed view of the tube being installed inside the striking zone insert of FIG. 5.
Figure 13:
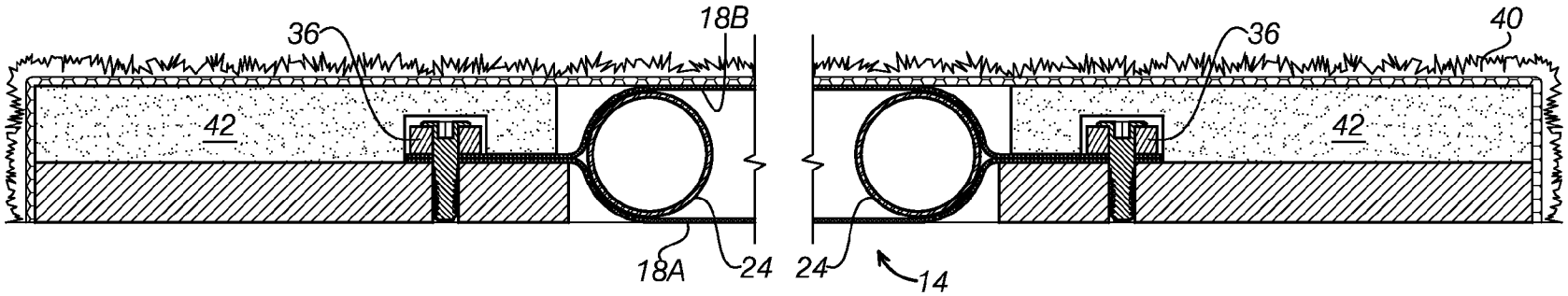
FIG. 13 illustrates a cross-sectional view taken along line 13-13 of FIG. 11.

Referring to FIGS. 4-6, a striking zone insert 18 may be disposed into the striking zone cutout 14. As shown in FIG. 13, the striking zone insert 18 may be made from two sheets 18A, 18B of flexible material, such as fabric, rubber, flexible polymeric material, or combinations thereof. For example, in one embodiment, an upper one of the two sheets can include both a fabric layer and a rubber layer, for example. Stitching 22 or other adhering mechanisms may be used to join the two sheets 18A, 18B together. The stitching 22 may have a size and shape generally the same as the size and shape of the striking zone cutout 14.

A closure, such as a zipper 20, may be disposed on a bottom side of the striking zone insert 18. The zipper 20 may permit access to an interior of the striking zone insert 18, between the two sheets 18A, 18B. A flexible tubular material, such as an inner tube 24 may be disposed inside the striking zone insert 18, extending about the perimeter as shown in FIG. 5, which shows the inner tube 24 disposed outside of the striking zone insert 18. The inner tube 24 may form a hollow region encased by the two sheets 18A, 18B of the striking zone insert 18. The inner tube 24 may include an air valve 26 for inflating the inner tube 24. In some embodiments, a hollow or solid flexible member may be used in place of the inner tube 24. The inner tube 24 may extend the height of the striking zone insert 18 to be substantially the same height as the standing area 12.

Straps 38 (see FIG. 8) may extend inside the striking zone insert 18 to secure the inner tube 24 about the inner perimeter of the stitching 22. The straps 38 may be disposed on the sides of the striking zone insert 18, as shown in the Figures, or may be disposed at various locations about the striking zone insert 18. In some embodiments, the straps 38 may be excluded and the structural integrity of the inner tube 24 may keep the inner tube 24 at the desired location inside the striking zone insert 18.

Figure 7:
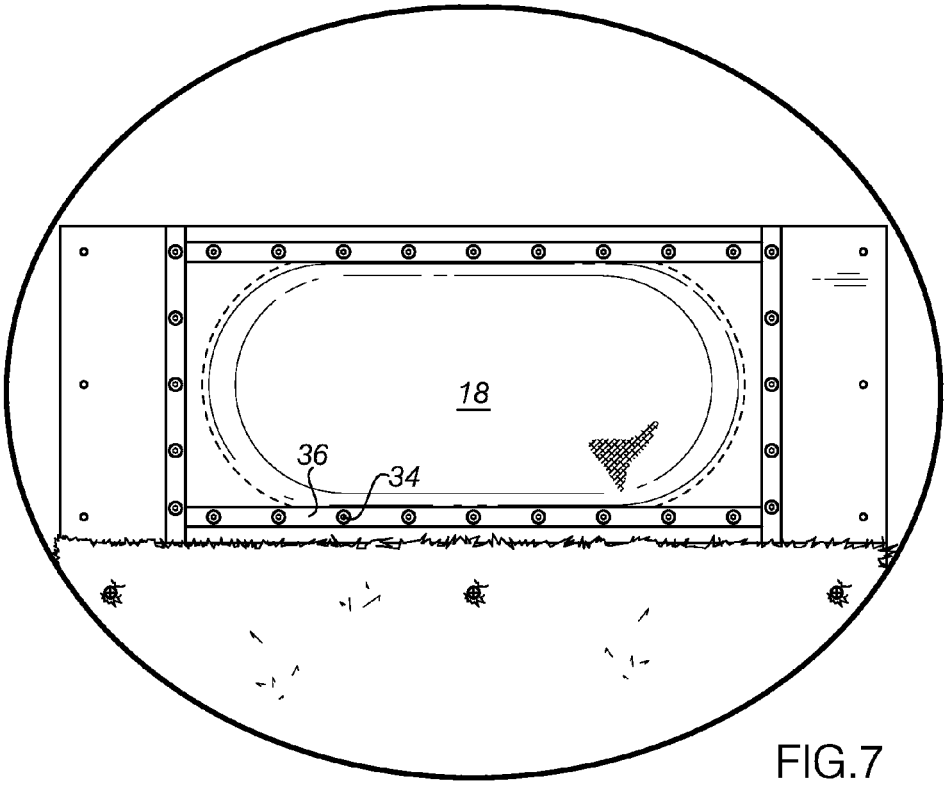
FIG. 7 illustrates a top view of the striking zone insert installed and held in place with brackets in the golf mat platform of FIG. 1.
Figure 8:
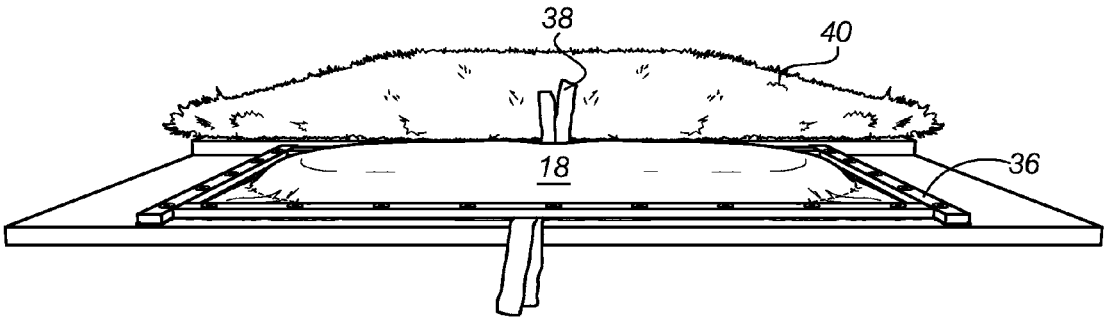
FIG. 8 illustrates a perspective end view of the golf mat platform of FIG. 1 with the striking zone insert installed.

Referring now to FIGS. 5, 7 and 8, mounting brackets 36 may be disposed about the outer perimeter of the striking zone insert 18. The mounting brackets 36 may align with the striking zone insert mounting holes 28 (see FIG. 2) and a bolt 34 may extend through the mounting brackets 36, through the striking zone insert mounting holes 28, and may be secured with a nut, 32, such as a T-nut, on a back side of the golf mat 10. The mounting brackets 36 may be formed from various materials and may be made in various shapes and sizes. Typically, the mounting brackets 36 are formed form a rigid, flat material, such as plastic, metal, wood, or the like. As shown in FIG. 8, typically, the mounting brackets 36 may have a height less than the height of the striking zone insert 18 when the inner tube 24 is disposed therein.

Figure 9:
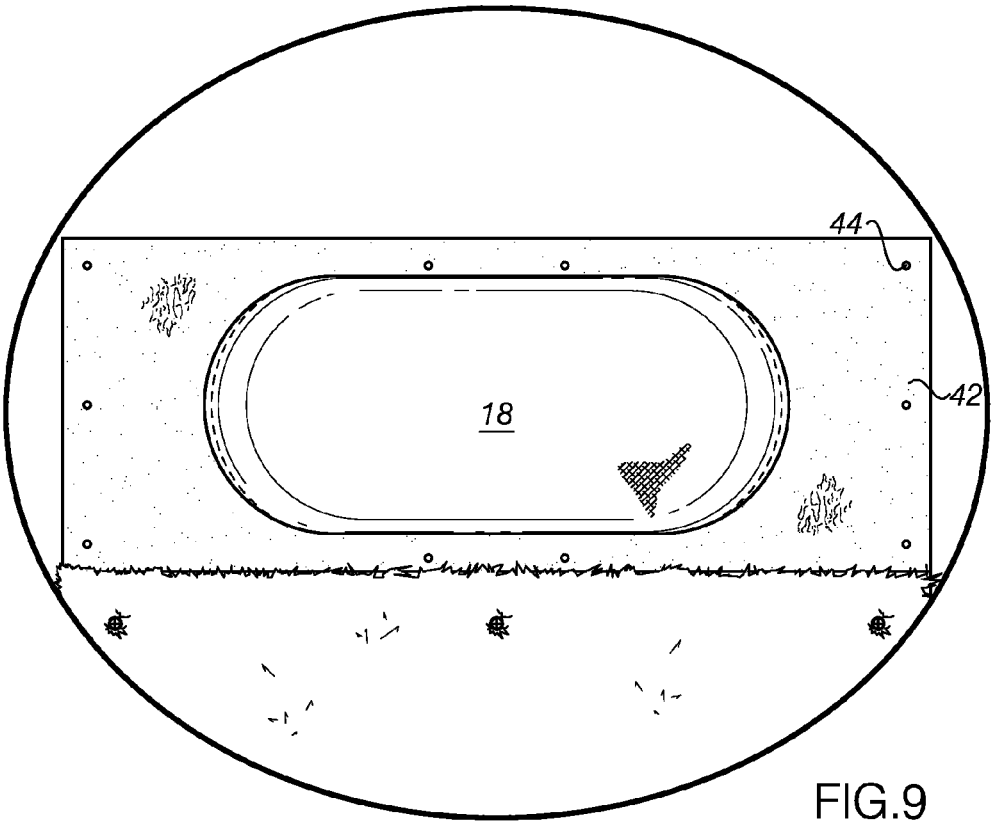
FIG. 9 illustrates a top view of the golf mat platform with striking zone insert installed of FIG. 7, further including a matting material positioned about the striking zone insert.
Figure 10:
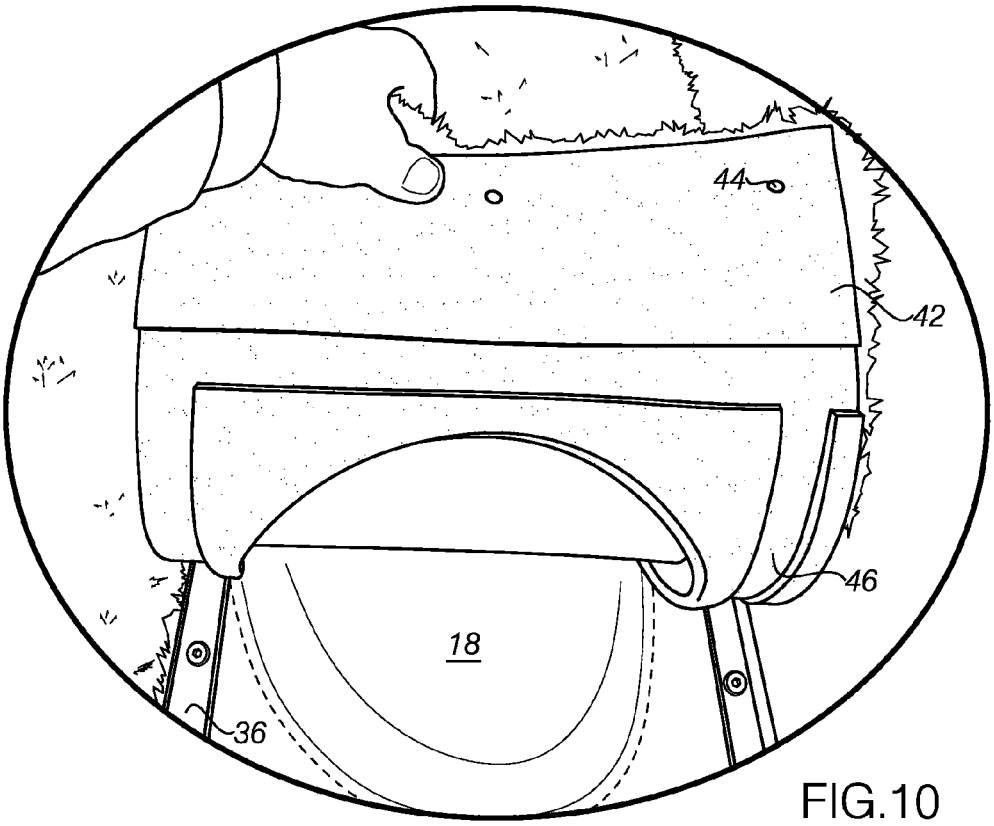
FIG. 10 illustrates a detailed perspective view showing placement of the matting material of FIG. 9.

Referring to FIGS. 9 and 10, a matting material 42 may be placed over the striking area 16 and around the raised portion (defined as the portion of the striking area insert 18 inside of the stitching 22) of the striking area insert 18. An underside of the matting material 42, as shown in FIG. 10, may include channels 46 for receiving the mounting brackets 36 therein. The matting material 42 may have a thickness to create a height of the striking zone 16 that is generally the same height as the standing area 12. The matting material 42 can be formed from various materials, such as foam rubber, foam sponge material, rubber, plastic, wood, metal, or the like. Typically, the matting material 42 may be formed from a flexible, resilient material.

Figure 11:
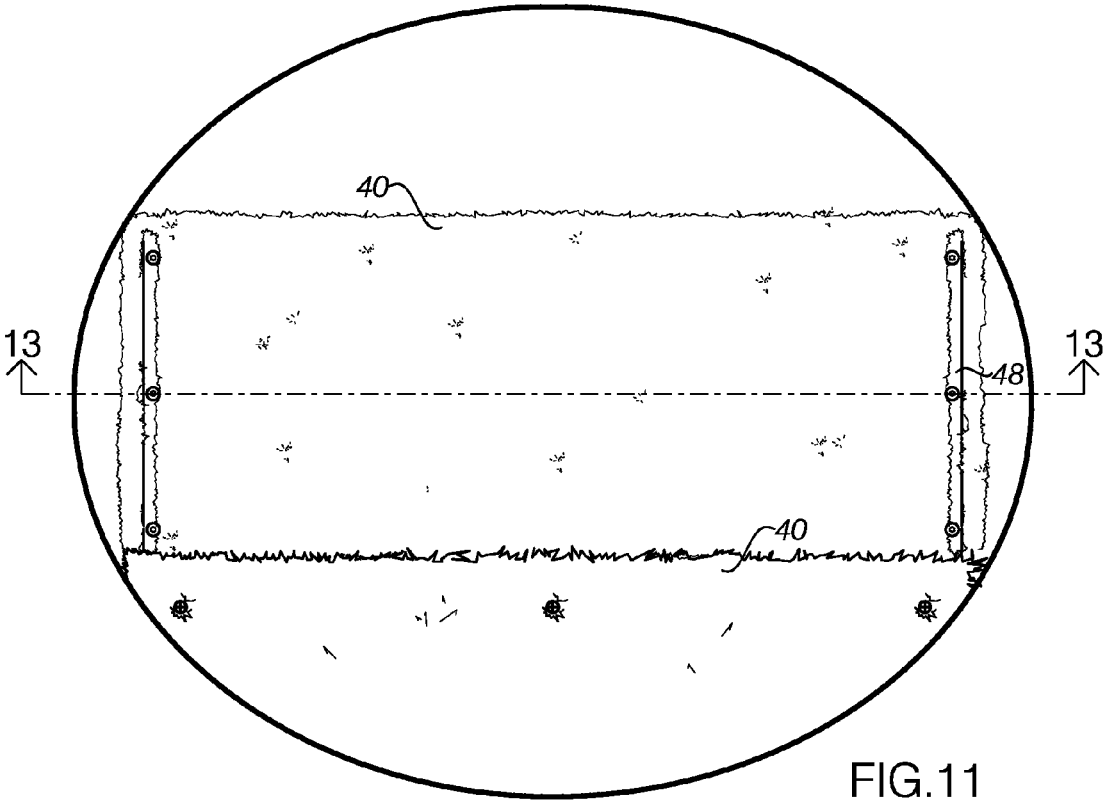
FIG. 11 illustrates a top view of the golf mat platform with turf installed and with the matting held in place with matting brackets.

The matting material 42 can include a plurality of matting material holes 44 typically aligning with mattering material mounting holes 30 formed in the striking area 16 (see FIG. 2). As shown in FIG. 11, matting material mounting brackets 48 may be disposed on front and rear ends to secure the matting material 42 and turf 40 to the golf mat 10. In some embodiments, side matting material mounting brackets 50 may be included to better secure the matting material 42 and turf 40 to the golf mat 10.

Figure 12:
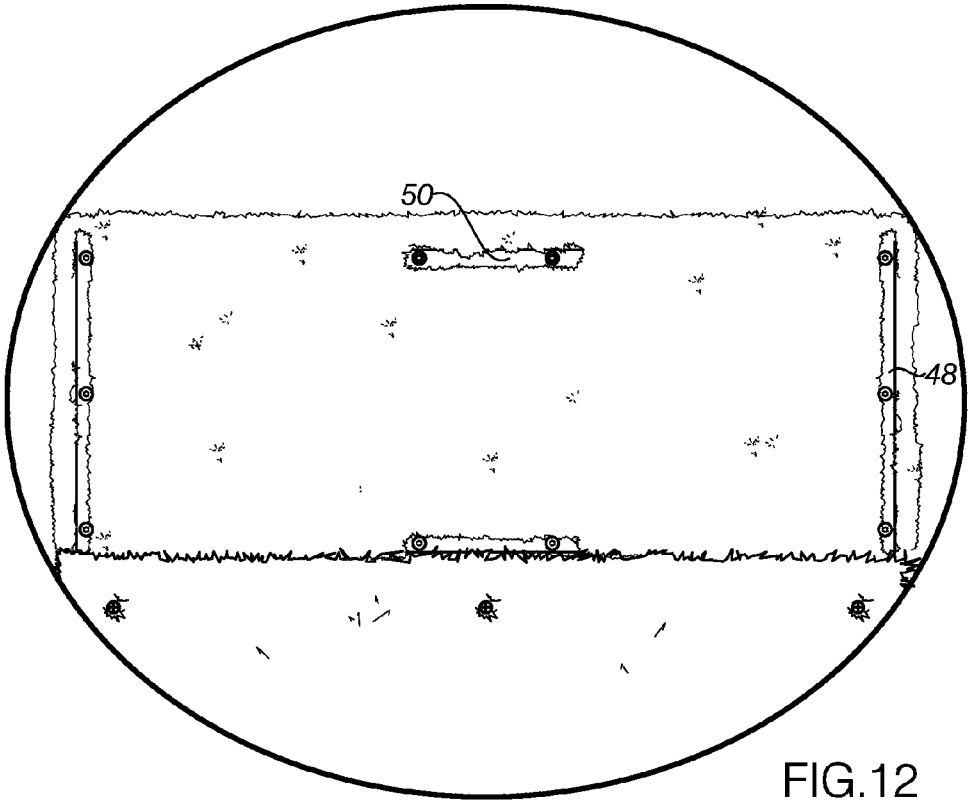
FIG. 12 illustrates a top view of alternative brackets for securing the turf and matting onto the golf mat platform.

To complete construction of the golf mat 10, turf 40 may be disposed over the standing area and over the striking zone 16 as shown in FIGS. 11 and 12. In some embodiments, a separate piece of turf 40, such as artificial turf, may be disposed over each zone 12, 16. This allows replacement of the turf 40 in the striking area 16 if needed from repeated use.

To use the golf mat 10, a user can disposed the golf mat 10 on a surface, such as on the ground, and place a golf ball above the hollow region of the striking zone insert 18. The matting material mounting brackets 48, 50 may be used to help align the golf ball. Generally, the golf ball 48, 50 may be disposed centrally between the brackets 48, 50. When the user swings a golf club, if the turf 40 is struck, the feedback/feel to the golfer is similar to that of natural grass. The combination of the inner tube 24 and the hollow striking zone insert 18 results in this replication of the feel of natural grass. However, by using the golf bat 10, a divot is not removed, but the turf 40 flexes with the striking zone insert and resiliently moves back to its original position after the swing, ready for the golfer's next swing.

The turf 40 can be chosen such that the golf ball may be placed directly on the turf 40, or may be suspended form the turf 40 on a tee.

The golf mat 10 may be used by an individual on any surface or multiple golf mats 10 may be aligned on a golf driving range, for example. In some embodiments, the standing area 12 of one golf mat 10 may be interconnected to a standing area 12 or a striking area 16 of an adjacent golf mat 10.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A golf mat comprising:

a striking area;

a striking area cutout formed in the striking area;

a striking area insert covering the striking area cutout and extending into the striking area, the striking area insert formed from a first sheet and a second sheet disposed atop of each other; and a flexible resiliently compressible ring disposed between the first sheet and the second sheet, the ring disposed within the striking area cutout about a periphery thereof, wherein a hollow region is formed between the first sheet and the second sheet, inside the ring.

2. The golf mat of claim 1, wherein the flexible resiliently compressible ring is an inner tube.

3. The golf mat of claim 1, further comprising stitching joining the first sheet and the second sheet, wherein the stitching forms a shape substantially matching a shape of the striking area cutout.

4. The golf mat of claim 1, further comprising a standing area disposed adjacent the striking area.

5. The golf mat of claim 4, wherein a height of the striking zone insert is substantially the same as a height of the standing area.

6. The golf mat of claim 1, further comprising:

mounting holes disposed about the striking area cutout, through the striking area;

mounting brackets disposed atop the striking zone insert; and bolts extending through the mounting brackets, through the striking zone insert and into the mounting holes, the bolts and mounting brackets securing the striking zone insert to the striking area.

7. The golf mat of claim 6, further comprising a matting material disposed about the striking zone insert, covering the striking area, wherein a bottom surface of the matting material includes channels for receiving the mounting brackets therein.

8. The golf mat of claim 1, further comprising a matting material disposed about the striking zone insert, covering the striking area.

9. The golf mat of claim 8, further comprising:

turf disposed atop the matting material;

matting material holes formed through the matting material;

matting material brackets; and bolts passing through the turf, matting material brackets, through the matting material holes and into the striking area, wherein the matting material brackets secure the turf and the matting material to the striking area.

10. The golf mat of claim 8, wherein a height of the matting material is substantially the same as a height of a standing area disposed adjacent the striking area.

11. The golf mat of claim 1, further comprising artificial turf covering the striking area.

12. The golf mat of claim 1, wherein at least one or the first sheet and the second sheet has a closure mechanism formed therein, providing access to the hollow region between the first sheet and the second sheet.

13. A golf mat comprising:

a striking area;

a standing area disposed adjacent the striking area;

a striking area cutout formed in the striking area;

a striking area insert covering the striking area cutout and extending into the striking area, the striking area insert formed from a first sheet and a second sheet disposed atop of each other;

a tubular ring disposed between the first sheet and the second sheet, the ring disposed within the striking area cutout about a periphery thereof, wherein a hollow region is formed between the first sheet and the second sheet, inside the ring; and a matting material disposed about the striking zone insert, covering the striking area.

14. The golf mat of claim 13, further comprising artificial turf covering the matting material and the standing area.

15. The golf mat of claim 13, further comprising stitching joining the first sheet and the second sheet, wherein the stitching forms a shape substantially matching a shape of the striking area cutout.

16. The golf mat of claim 13, further comprising:

mounting holes disposed about the striking area cutout, through the striking area;

mounting brackets disposed atop the striking zone insert; and bolts extending through the mounting brackets, through the striking zone insert and into the mounting holes, the bolts and mounting brackets securing the striking zone insert to the striking area.

17. The golf mat of claim 13, wherein a height of the striking zone insert is substantially the same as a height of the standing area.

18. The golf mat of claim 13, wherein a height of the matting material is substantially the same as a height of the standing area.

19. A golf mat comprising:

a striking area;

a standing area disposed adjacent the striking area;

a striking area cutout formed in the striking area;

a striking area insert covering the striking area cutout and extending into the striking area, the striking area insert formed from a first sheet and a second sheet disposed atop of each other;

a tubular ring disposed between the first sheet and the second sheet, the ring disposed within the striking area cutout about a periphery thereof, wherein a hollow region is formed between the first sheet and the second sheet, inside the ring; and a matting material disposed about the striking zone insert, covering the striking area, wherein a first height of the striking zone insert is substantially the same as a second height of the standing area; and a third height of the matting material is substantially the same as the second height of the striking area and the first height of the striking zone.

20. The golf mat of claim 19, further comprising artificial turf covering the matting material and the standing area.

21. The golf mat of claim 19, further comprising stitching joining the first sheet and the second sheet, wherein the stitching forms a shape substantially matching a shape of the striking area cutout.

* * * * *